US005839867A

United States Patent [19]

Schmucki et al.

[11] Patent Number: 5,839,867

[45] Date of Patent: Nov. 24, 1998

[54] WALL SUPPORT AT A MOUNTING FRAME

[75] Inventors: Peter Schmucki, Eschenbach; Silvio Marti, Rapperswil; Alfred Mahler, Jona, all of Switzerland

[73] Assignee: Geberit Technik AG, Jona, Switzerland

[21] Appl. No.: 791,476

[22] Filed: Jan. 27, 1997

[30] Foreign Application Priority Data

Jan. 25, 1996 [CH] Switzerland ..... 194/96

[51] Int. Cl.[6] ..... F01B 9/12

[52] U.S. Cl. ..... 411/337; 411/366; 248/222.14

[58] Field of Search ..... 248/544, 274.1, 248/205.1, 231.91, 292.14, 220.22, 222.14; 411/337, 367, 351, 366

[56] References Cited

U.S. PATENT DOCUMENTS

| | | | |
|---|---|---|---|
| 1,293,375 | 2/1919 | Dodds | 411/337 |
| 3,222,744 | 12/1965 | Dellith | 411/337 X |
| 4,921,382 | 5/1990 | Fries et al. | 411/337 X |
| 5,234,300 | 8/1993 | Fluckiger | 411/337 X |

FOREIGN PATENT DOCUMENTS

| | | |
|---|---|---|
| 0076945 A | 4/1983 | European Pat. Off. . |
| 0 731 226 A | 9/1996 | European Pat. Off. . |
| 3410499 A | 8/1985 | Germany . |
| 9412649 U | 11/1994 | Germany . |
| 598 438 A | 4/1978 | Switzerland . |

*Primary Examiner*—Leslie A. Braun
*Assistant Examiner*—T. Le
*Attorney, Agent, or Firm*—McGlew and Tuttle

[57] ABSTRACT

The wall support including at least one connecting piece arranged at the mounting frame and a fastening part fixed to a free end of the connecting piece. The fastening part is to be fixed at a building wall. The connecting piece grips into an opening of a hollow profile of the mounting frame and is arranged at a pre-mountable insertion piece, disposed behind this opening in the hollow profile. The insertion piece and the connecting piece form preferably a unit, which is locked into a bore of the hollow profile.

12 Claims, 2 Drawing Sheets

WALL SUPPORT AT A MOUNTING FRAME

FIELD OF THE INVENTION

The invention relates to a wall support with a mounting frame for sanitary devices at least one connecting piece is arranged on the mounting frame, and a fastening part for fixation to a building wall is fixed to a free end of the connecting piece.

BACKGROUND OF THE INVENTION

Wall supports of this kind are known and serve to fix mounting frames in individual mountings on a building wall. The fastening part is an elongated plate with a long slot, which is, for example, fixed at the building wall with a dowel. The connecting piece is a threaded bolt, which is fixedly integrated into the mounting frame and which is screwed into a sleeve-shaped insertion piece of the fastening part. By turning the threaded bolt, a ridgeless or continuous depth adjustment of the mounting frame is possible.

Mounting frames are used in particular for the installation of urinary, water closet and lavabo devices. The wall support has, correspondingly, to withstand comparatively high forces. In the wall support, the threaded bolt is arranged in a special corner element of the mounting frame. The mounting frame may, therefore, only be reasonably used for front wall mounting. However, a mounting frame which may be used at choice for the front wall mounting or frame mounting would be desirable.

SUMMARY AND OBJECTS OF THE INVENTION

According to the invention, a wall support is proposed, in which the connecting piece grips into an opening of a hollow profile of the mounting frame, and is arranged at an pre-mountable insertion piece, disposed behind this opening in the hollow profile. The pre-mountable insertion piece is, according to a further embodiment of the invention, a sleeve, which is inserted into a bore of the hollow profile. The sleeve forms preferably a construction unit with a threaded bolt. If the mounting frame is to be used for the front wall mounting, the construction unit is fixed at the mounting frame. In the case of a frame mounting, the mounting frame is used without such a construction unit, and therefore, without a wall support. For both kinds of mounting, the same mounting frame may thus be used.

According to a further embodiment of the invention, the insertion piece is a sleeve, which is inserted, in particular locked, into a bore of the hollow profile. This enables a fixation of the wall support at the mounting frame substantially without tools. The threaded bolt forms preferably a construction unit with the sleeve. The sleeve can, in this case, be inserted together with the threaded bolt into the bore of the mounting frame. This enables in the case of a front wall mounting, a very simple and quick fixation of the wall support. It is advantageous as well, that no special corner element is needed for the wall support of the mounting frames. The necessary opening for the insertion piece is preferably a bore and needs therefore only a very simple machining of the mounting frame.

According to a further embodiment of the invention, a wall angle-iron and a covering angle-iron are disposed at the end of the connecting piece near the wall. The covering angle-iron enables a substantially simplified mounting of covering elements. If the covering angle-iron, according to a further embodiment of the invention, is rotatably locked on the wall angle-iron, an especially simple mounting and, in addition, a simple and precise alignment of the covering angle-iron are enabled.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

Further advantageous features are given in the dependent patent claims, in the subsequent description, as well as in the drawings.

An exemplary embodiment of the invention is subsequently described in conjunction with the drawings, showing:

DETAILED DESCRIPTION OF THE PREFERRED EMBODIMENTS

Figure 1:
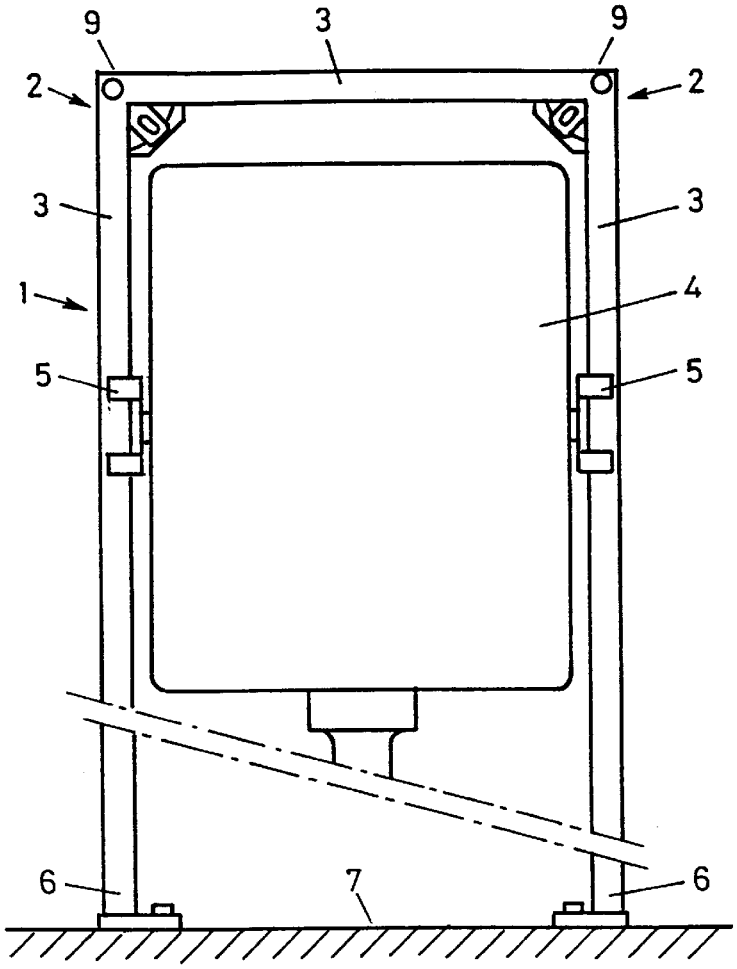
FIG. 1 schematically, a partial view of a mounting frame with two wall supports, FIG. 2 a view of a part of the wall support, FIG. 3 a further view of the part according to FIG. 2, FIG. 4 a horizontal cross section of the wall support according to the invention, FIG. 5 a cross section of a part of the wall support, and FIG. 6 a view of the part according to FIG. 5.

FIG. 1 shows schematically a mounting frame 1, which has two wall supports 2 at two corners 9 of a rectangular frame of hollow profile tubing or members 3. The mounting frame 1 comprises two supporting feet 6, which are screwed to a building floor 7. A hidden water tank 4 is arranged with connecting means 5 in the frame 1. Below this, for example, a not shown closet device is fixed in an in itself known way at the mounting frame 1.

Figure 4:
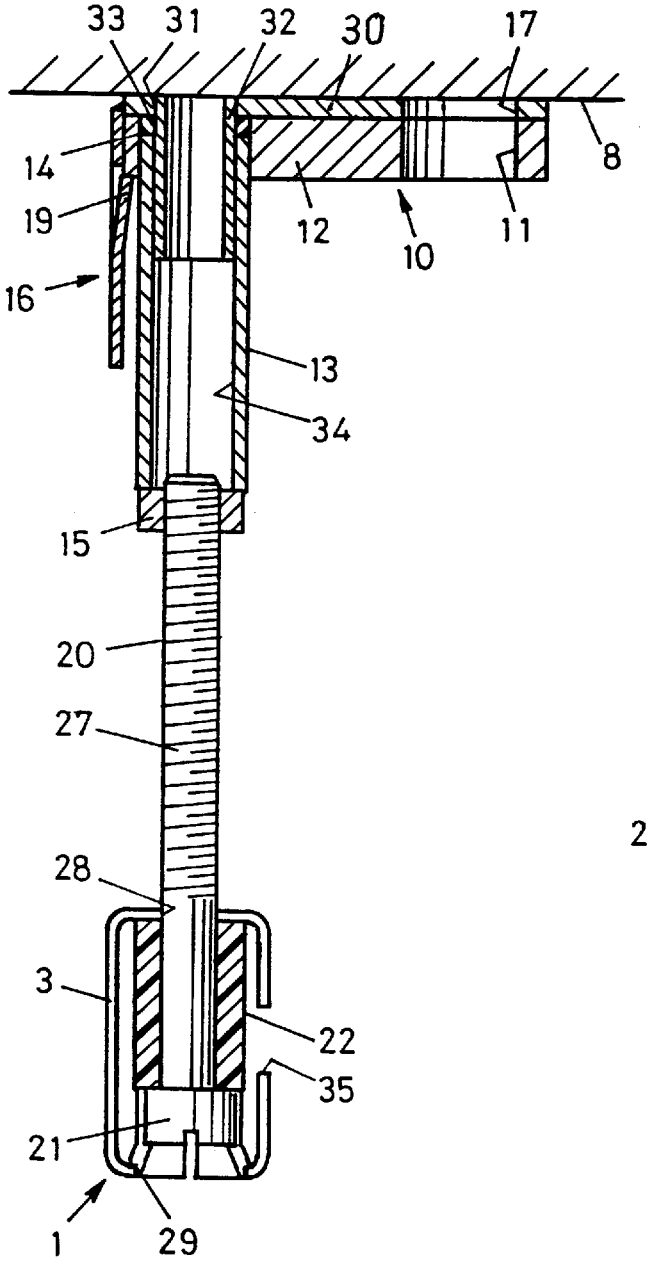
Figure 5:
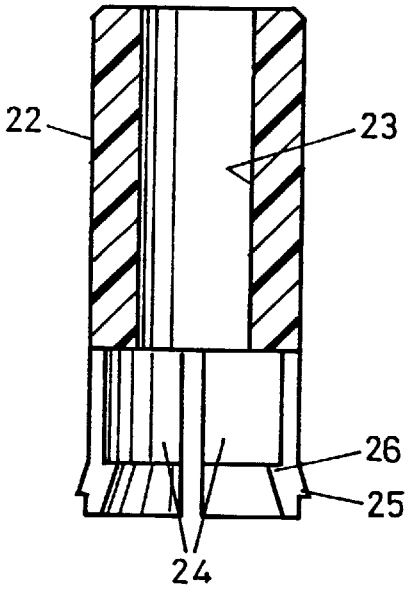
Figure 6:
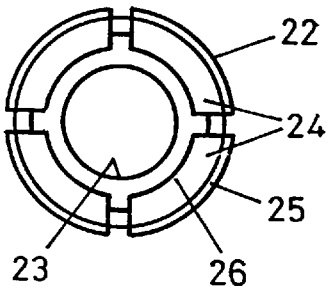

As especially shown by FIG. 4, the two wall supports 2 comprise each a threaded bolt 20, with an exterior thread 27 and a head 21. The head-end of the bolt 20 is arranged in an insertion piece 22, which is inserted, through a bore 29, into one of the hollow profile tubes 3. Locking tongue means 24, attached to the insertion piece 22, as well as exterior locking cams 25 secure the bolt 20 rotatably in the insertion piece 22, and at the same time secure the insertion piece 22 in the hollow profile tube 3. The insertion piece 22 forms a unit with the threaded bolt 20, which, for mounting, has only to be inserted through the bore 28 and 29 into the hollow profile tube 3.

The threaded bolt 20 protrudes, via a bore 28, out of the back side of the mounting frame 1, and is screwed at its free end into a thread 15 at a bearing sleeve 13 of a wall angle-iron or wall-fastening means 10. A plate 12 comprises, for the fixation of the wall angle-iron 10, a long slot 11. By rotating the threaded bolt 20, the distance between the mounting frame 1 and the building wall 8 can be ridgeless or continuously adjusted.

Figure 2:
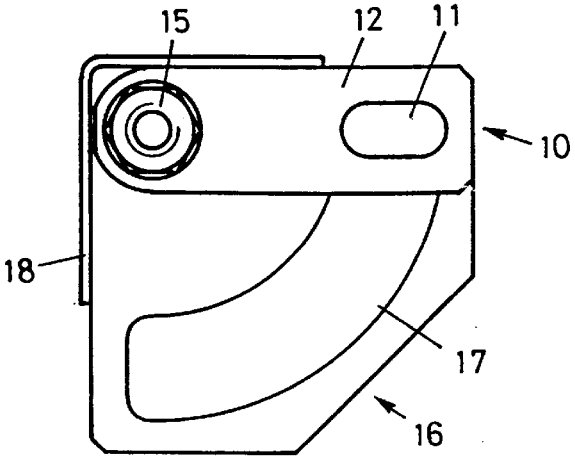
Figure 3:
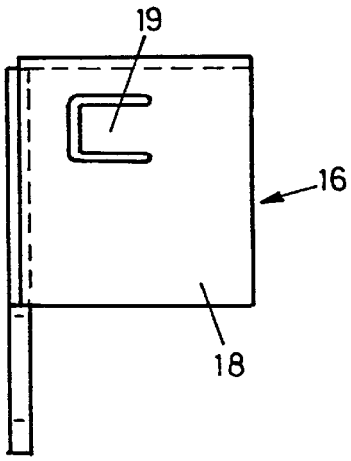

Axially disposed on the wall angle-iron 10, is a covering angle-iron device 16 with a plate 30. The angle-iron device 16 is fixed by means of a locking tongue 19 and the plate 30 to the plate 12. The angle-iron device is positioned against the building wall 8. The angle-iron device also has an angle-shaped side wall 18 which stands off vertically from the building wall 8. The plate 30 has a vertically protruding sleeve 32. The sleeve 32 grips into a bore 34 of the bearing sleeve 13 and into a bore 31 of the plate 30 and connects the wall angle-iron 10 rotatably with the covering angle-iron 16. A bow-shaped long slot 17 is machined, according to FIG. 2, into the plate 30. The slot 17 coincides with the long slot 11 within a rotation range of 90°. The side wall 18 can herewith, by rotating the covering angle-iron 16, be accurately adjusted for the mounting of covering elements. This holds for both wall supports 2, which are disposed mirror-symmetrically with respect to each other, but which are otherwise equal, and whose covering angle-irons 16 can be accurately adjusted independently of each other for the mounting of covering elements. The wall angle-iron 10 and the covering angle-iron 16 form preferably a unit, too. As shown in FIG. 4, the plate 30 is unremovably connected by a weld mark 33 with the sleeve 13. Another weld mark 14 connects the sleeve 32 with the plate 12.

The mounting of the wall supports 2 at the frame 1 is very simple. To this end, the pre-mounted construction unit, consisting of the threaded bolt 20 and the insertion piece 22 as mentioned above, is inserted into the bores 28 and 29 of the hollow profile tubes 3. The construction unit, consisting of the two angle-irons 10 and 16, is now screwed onto the protruding end of threaded bolt 20. For the front wall mounting, the mounting frame 1 can therefore be fitted with both wall supports 2 very quickly and substantially without tools. After the fixation of the wall supports 2 at the building wall 8, the depth adjustment can be performed from the front side by rotating the threaded bolts 20. To this end, a screw-driver is inserted via bore 28 and applied to head 21. The adjusted depth can be secured by means of a not shown lock-nut, which is screwed onto the threaded bolt 20. The lock-nut can be a part of the insertion piece 22, and would then be disposed at the interior of the hollow profile tube 3. In order to rotate the lock-nut, an appropriate fork spanner can be introduced via a long slot 35 of the hollow profile tube 3. The wall supports 2 consist preferably of metal pieces, the insertion piece 22, however, is preferably a die-casted piece, made of an appropriate plastic.

While specific embodiments of the invention have been shown and described in detail to illustrate the application of the principles of the invention, it will be understood that the invention may be embodied otherwise without departing from such principles.

We claim:

1. A wall support for sanitary devices, the support comprising:

a mounting frame formed of a hollow member, said member defining an opening;

a connecting piece positioned on said mounting frame and secured to said opening of said member, said connecting piece being formed as a threaded bolt and including a free end extending from said mounting frame;

an insertion piece positioned in said mounting frame and adjacent said opening of said member, said insertion piece connecting said connecting piece to said opening of said member, said connecting piece and said insertion piece form a construction unit which is pre-mountable with said mounting frame; and a wall fastening means for fixation to a building wall and connectable to said free end of said connecting piece, said wall fastening means includes a wall angle-iron and a covering angle-iron, said covering angle-iron is axially fixed and rotatably connected to said wall angle-iron.

2. A wall support in accordance with claim 1, wherein:

said threaded bolt includes a head rotatably and axially secured.

3. A wall support in accordance with claim 1, wherein:

said threaded bolt includes a head, said insertion piece rotatably connects said head to said mounting frame, said insertion piece axially fixes said threaded bolt to said mounting frame.

4. A wall support in accordance with claim 1, wherein:

said threaded bolt is insertable into said insertion piece, said insertion piece includes locking tongue means for locking said threaded bolt in said insertion piece.

5. A wall support in accordance with claim 4, wherein:

said insertion piece is a sleeve inserted into a bore of said member.

6. A wall support in accordance with claim 1, wherein:

said insertion piece includes a lock-nut.

7. A wall support in accordance with claim 1, wherein:

said member of said mounting frame is a long-slotted hollow profile tubing.

8. A wall support in accordance with claim 1, wherein:

said insertion piece includes locking tongue means for axially securing said connecting piece in said insertion piece.

9. A wall support in accordance with claim 1, wherein:

said covering angle-iron is rotatably locked on said wall angle-iron.

10. A wall support in accordance with claim 1, wherein:

said wall angle-iron includes a bearing sleeve extending perpendicularly to the building wall, said covering angle-iron being rotatably connected to said bearing sleeve, said connecting piece connecting to said bearing sleeve in a longitudinally variable fashion.

11. A wall support for a sanitary device, the support comprising:

a mounting frame formed of a hollow member, said member defining an opening extending through member and said member including means for connecting to the sanitary device;

a connecting piece positioned in said opening of said mounting frame, said connecting piece including a free end extending from said mounting frame;

an insertion piece positionable in said opening of said mounting frame, said insertion piece and said opening including means for inserting said insertion piece through one end of said opening and axially securing said insertion piece in said member after said insertion piece has been inserted in said opening, said insertion piece and said connecting piece including means for rotatably connecting and axially fixing said connection piece to said member; and a wall fastening means for fixation to a building wall, said wall fastening means includes a wall angle-iron and a covering angle-iron, said wall angle-iron being connectable to said free end of said connecting piece, said covering angle-iron being rotatably connected and axially fixed to said wall angle-iron.

12. A support in accordance with claim 11, wherein:

said covering angle-iron is rotatable with respect to said mounting frame and said member.

* * * * *